US006045438A

United States Patent [19]

Shay

[11] Patent Number: 6,045,438

[45] Date of Patent: Apr. 4, 2000

[54] AXIS BLOCK ASSEMBLY FOR USE IN MAKING PRESCRIPTION EYEGLASS LENSES

[76] Inventor: William D. Shay, 2828 Dills Rd., Hiawassee, Ga. 30546

[21] Appl. No.: 09/090,824

[22] Filed: Jun. 4, 1998

[51] Int. Cl.[7] ..... B24B 1/00

[52] U.S. Cl. ..... 451/384; 451/43; 451/42

[58] Field of Search ..... 451/42, 43, 384, 451/390, 921

[56] References Cited

U.S. PATENT DOCUMENTS

| | | |
|---|---|---|
| 3,893,264 | 7/1975 | Behnke . |
| 4,229,911 | 10/1980 | Bicskei . |
| 4,288,946 | 9/1981 | Bicskei . |
| 4,479,332 | 10/1984 | Stern et al. . |
| 4,989,316 | 2/1991 | Logan et al. . |
| 5,505,654 | 4/1996 | Wood et al. . |
| 5,908,348 | 6/1999 | Gottschald . |

*Primary Examiner*—Timothy V. Eley
*Assistant Examiner*—Willie Berry, Jr.
*Attorney, Agent, or Firm*—Adams Law Firm, P.A.

[57] ABSTRACT

An axis block assembly is attached to a block holder arm of a lapping machine. The axis block assembly cooperates with a lens block to hold a lens blank in contact with a lap tool used for finishing a surface of the lens blank. The block holder arm moves the axis block assembly between a raised loading position spaced above the lap tool for loading the lens block and lens blank in the lapping machine, and lowered operative position for locating the axis block assembly proximate the lap tool during operation of the lapping machine. The axis block assembly includes a mounting block for being attached to an end of the block holder arm. An axis block is carried by the mounting block. The axis block has a magnetic surface adapted for engaging a metal base surface of the lens block for holding the lens block against the axis block as the axis block assembly moves from the raised loading position to the lowered operative position proximate the lap tool.

16 Claims, 16 Drawing Sheets

AXIS BLOCK ASSEMBLY FOR USE IN MAKING PRESCRIPTION EYEGLASS LENSES

TECHNICAL FIELD AND BACKGROUND OF THE INVENTION

This invention relates generally to a process for making prescription eyeglass lenses, and particularly to an axis block assembly applicable for use in one or more lens processing stations.

In general terms, prescription eyeglass lenses are made from a toric or cylindrical ophthalmic, lens blank having an essentially concave lens surface and an opposing convex surface. The convex surface of the lens blank is mounted on a lens block using a heated bonding medium, such as liquid wax, which hardens when cooled to join the lens blank and lens block together. The concave lens surface is exposed for processing. The joined lens block and lens blank are then moved to a lens cutting machine which cuts the lens surface to a Shape corresponding to a given prescription. After cutting, the lens block and lens blank are moved to a surface finishing or "lapping" machine where the cut lens surface is smoothed and polished. The lapping machine includes a lap tool which moves over the lens surface in a high-speed, generally elliptical orbit.

The axis block assembly of the present invention facilitates loading of the lens block and lens blank in the lapping machine, and provides for forward and rearward pivoting movement and side-to-side movement of the lens block and lens blank during actuation of the lap tool. According to one prior art assembly, the block holder allows slight movement of the lens block and lens blank in a side-to-side direction, but restricts pivoting movement in a forward and rearward direction. Because of the generally elliptical orbit of the lap tool and the restricted movement of the lens block and lens blank, the block holder experiences a substantial amount of wear over a relatively short period of use. Frequent replacement of the block holder is time consuming and expensive. Furthermore, the prior art block holder requires the operator to manually hold the lens block as the block holder moves from the raised loading position to an operative position adjacent the lap tool. This process can result in misalignment of the lens blank over the surface of the lap tool, and can cause injury to the fingers of an inattentive operator.

SUMMARY OF THE INVENTION

Therefore, it is an object of the invention to provide an axis block assembly for use in a process for making prescription eyeglass lenses.

It is another object of the invention to provide an axis block assembly which facilitates loading the lens block and lens blank in the lapping machine.

It is another object of the invention to provide an axis block assembly which does not require the operator to manually hold the lens block as the lens block and lens blank are loaded in the lapping machine.

It is another object of the invention to provide an axis block assembly which allows forward and rearward pivoting movement and side-to-side movement of the lens block and lens blank luring actuation of the lap tool.

It is another object of the invention to provide an axis block assembly which requires relatively little maintenance and repair.

It is another object of the invention to provide an axis block assembly which can be readily retrofitted onto a conventional block holder arm of a lapping machine.

It is another object of the invention to provide an axis block assembly which includes means for conveniently aligning and setting the axis.

It is another object of the invention to provide an axis block assembly which omits the use of elongate vertical block pins. The block pins are subject to wear and require frequent replacement. After each pin replacement, the axis must be realigned and reset. This process is generally burdensome and time consuming. The present invention substantially reduces the number of times the axis must be aligned and set over the useful life of the machine.

It is another object of the invention to provide a heating assembly which uniformly heats the bonding medium used for joining the lens block and lens blank together.

It is another object of the invention to provide a heating assembly which is highly efficient.

It is another object of the invention to provide a device for conveniently removing the bonding medium from the lens block after finishing the surface of the lens blank.

It is another object of the invention to provide a lens block which is shaped such that the bonding medium contacts a substantial surface area of the lens block and lens blank.

It is another object of the invention to provide a lens block which resists inadvertent separation the lens blank from the lens block during processing.

It is another object of the invention to provide a lens alignment and blocking machine while allows convenient transfer of the lens blank from an alignment station to a blocking station.

It is another object of the invention to provide a method for holding a lens block adjacent an axis block secured to a block holder arm of a lapping machine during actuation of the block holder arm from a raised loading position spaced above a lap tool to a lowered operative position adjacent the lap tool.

These and other objects of the present invention are achieved in the preferred embodiments disclosed below by providing an axis block assembly for being attached to a block holder arm of a lapping machine. The axis block assembly cooperates with a lens block to hold a lens blank in contact with a lap tool used for finishing a surface of the lens blank. The block holder arm moves the axis block assembly between a raised loading position spaced above the lap tool for loading the lens block and lens blank in the lapping machine, and lowered operative position for locating the axis block assembly proximate the lap tool during operation of the lapping machine.

The axis block assembly includes a mounting block for being attached to an end of the block holder arm. An axis block is carried by the mounting block. The axis block has a magnetic surface adapted for engaging a metal base surface of the lens block for holding the lens block against the axis block as the axis block assembly moves from the raised loading position to the lowered operative position proximate the lap tool.

According to one preferred embodiment of the invention, the magnetic surface of the axis block is defined by a centrally disposed magnetic disk located within an annular recess formed in the axis block.

According to another preferred embodiment of the invention, the mounting block has a top wall with an opening therein for alignment with a corresponding opening formed adjacent the end of the block holder arm. An attachment bolt is received through each of the aligned openings for attaching the mounting block to the block holder arm. The attachment bolt allows adjustment of the mounting block about an axis defined by the attachment bolt in order to properly align the axis.

According to yet another preferred embodiment of the invention, first and second spaced-apart axis adjustment heads are formed with the top wall of the mounting block on opposite sides of the attachment bolt opening. The adjustment heads have respective adjustment bolt openings forward of the attachment bolt opening and receiving adjustment bolts for adjustably locking the mounting block in position on the block holder arm.

According to yet another preferred embodiment of the invention, the mounting block includes spaced-apart opposing side walls formed with the top wall and residing on opposite sides of the axis block for locating the axis block within the axis block assembly.

According to yet another preferred embodiment of the invention, the axis block includes first and second axially-aligned mounting shafts extending within respective side walls of the mounting block.

According to yet another preferred embodiment of the invention, first and second shaft bearings are located adjacent respective side walls of the mounting block for receiving respective ends of the first and second mounting shafts for pivoting movement of the shafts within the bearings.

According to yet another preferred embodiment of the invention, the first and second mounting shafts have respective tapered ends received within the side walls of the mounting block.

According to yet another preferred embodiment of the invention, first and second conical shaft bearings are located adjacent respective side walls of the mounting block for receiving respective tapered ends of the first and second mounting shafts for pivoting movement of the shafts within the bearings.

According to yet another preferred embodiment of the invention, the axis block includes first and second spaced-apart axis pins adapted for being received within respective pin openings formed in the base surface of the lens block for holding the lens block in position during operation of the lapping machine.

According to yet another preferred embodiment of the invention, first and second covers are removably attached to an outside of respective side walls.

In another embodiment, an axis block assembly is attached to a block holder arm of a lapping machine, and cooperates with a lens block to hold a lens blank in contact with a lap tool used for finishing a surface of the lens blank. The block holder arm moves the axis block assembly between a raised loading position spaced above the lap tool for loading the lens block and lens blank in the lapping machine, and lowered operative position for locating the axis block assembly proximate the lap tool during operation of the lapping machine. The axis block assembly includes a mounting block for being attached to an end of the block holder arm. An axis block is carried by the mounting block. Pivot attachment means are provided for pivotably attaching the axis block to the mounting block. The pivot attachment means allows pivoting movement of the axis block relative to the mounting block during operation of the lapping machine.

In yet another embodiment, a method is provided for holding a lens block adjacent an axis block secured to a block holder arm of a lapping machine during actuation of the block holder arm from a raised loading position spaced above a lap tool to a lowered operative position adjacent the lap tool. The method includes the steps of providing a magnetic surface on the axis block adapted for attracting and engaging a metal base surface of the lens block. Then, with the block holder arm in the raised loading position, the lens block is placed against the axis block with the metal base surface of the lens block adjacent the magnetic surface of the axis block. The block holder arm is then lowered from the raised loading position to the operative position with the lens block magnetically held to the axis block.

BRIEF DESCRIPTION IF THE DRAWINGS

Some of the objects of the invention have been set forth above. Other objects and advantages of the invention will appear as the description proceeds when taken in conjunction with the following drawings, in which.

Figure 19:
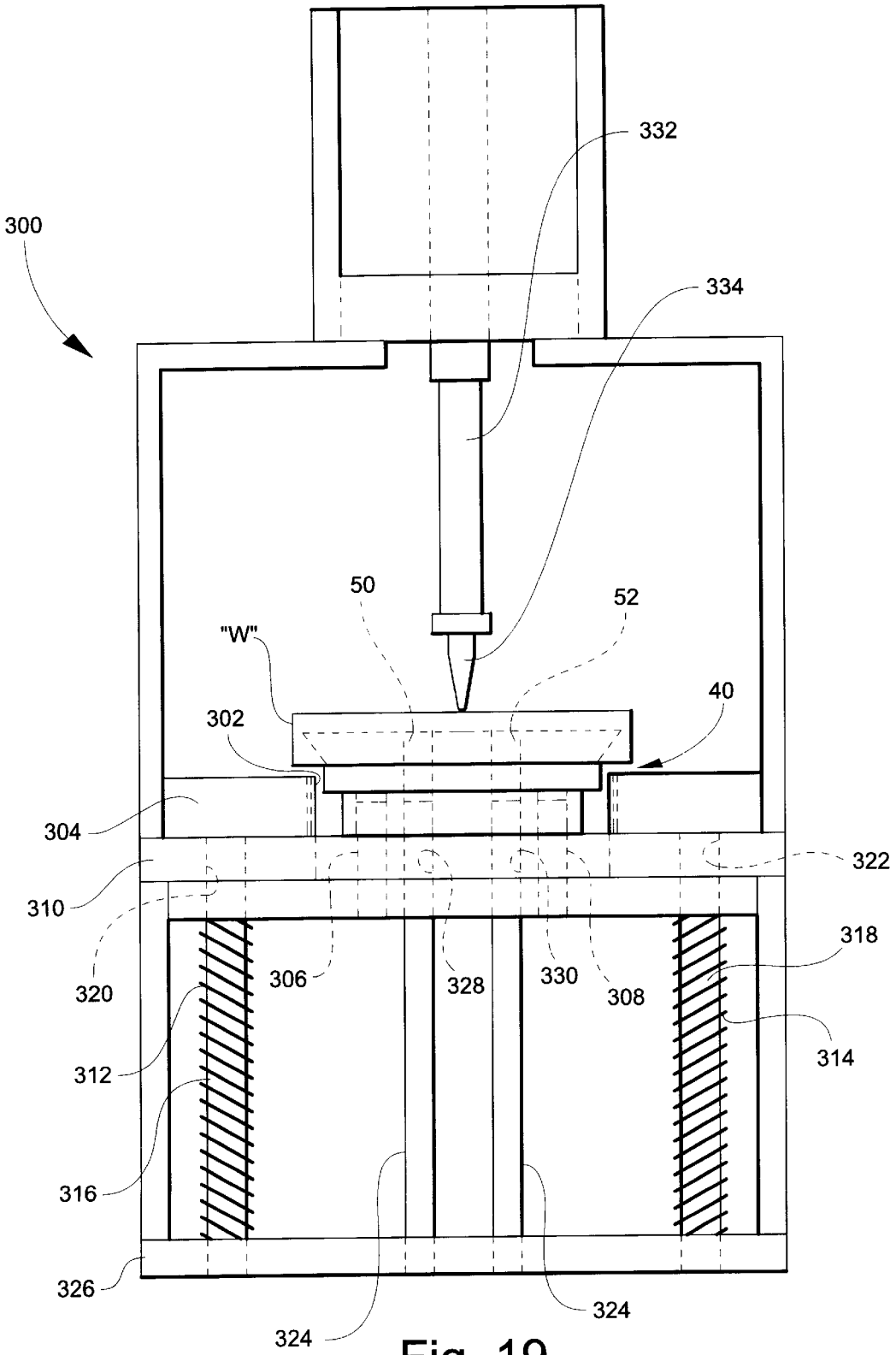
Figure 20:
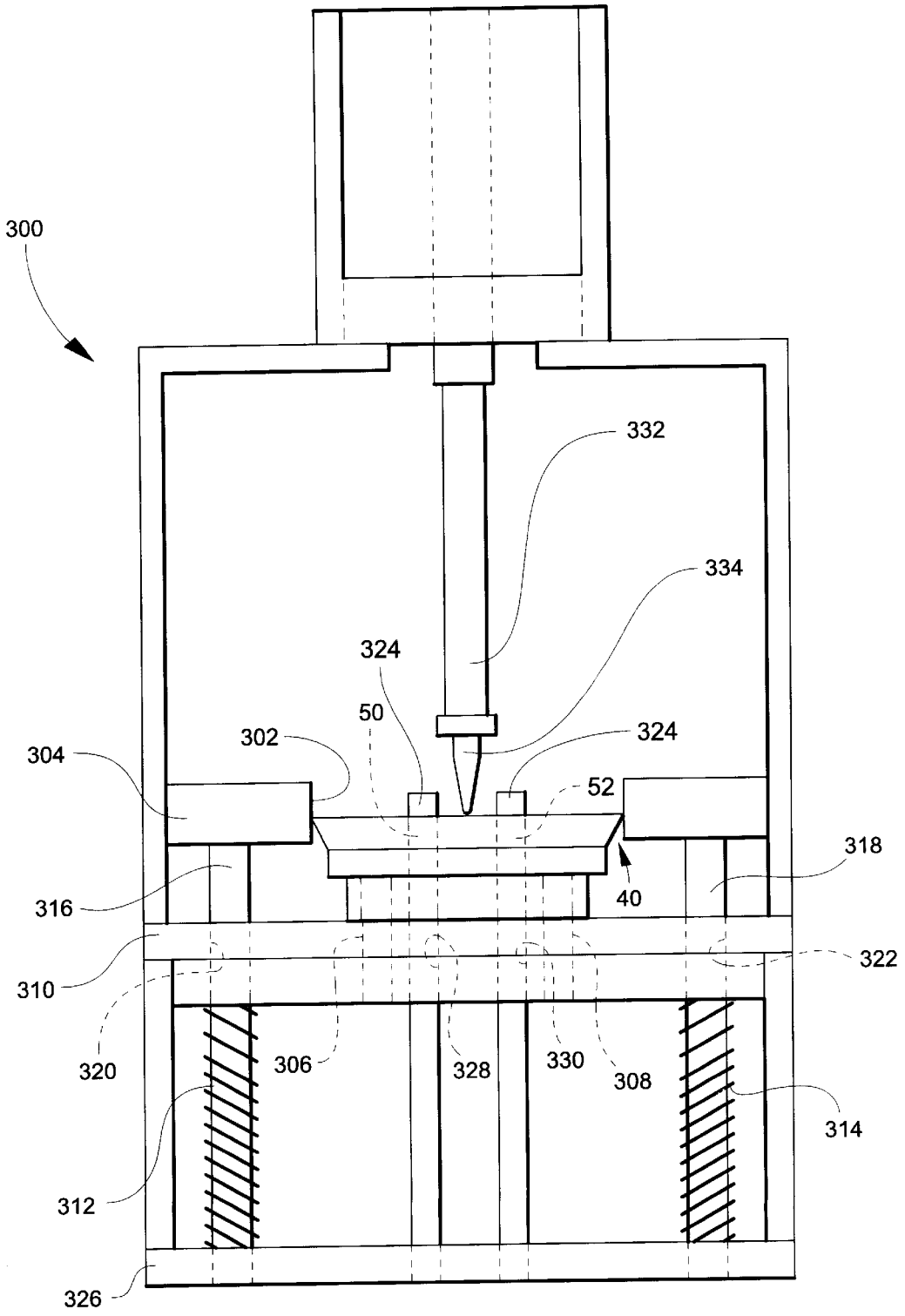

FIG. 19 is an elevational view of the wax removal device with the lens blank located in the opening of the top floor prior to wax removal, and showing the pneumatic cylinder in an extended position; and FIG. 20 is an elevational view of the wax removal device with the lens blank located in the opening of the top floor during wax removal, and showing the pneumatic cylinder in a further extended position pushing the base of the lens block through the opening in the top floor.

DESCRIPTION OF THE PREFERRED EMBODIMENT AND BEST MODE

Figure 1:
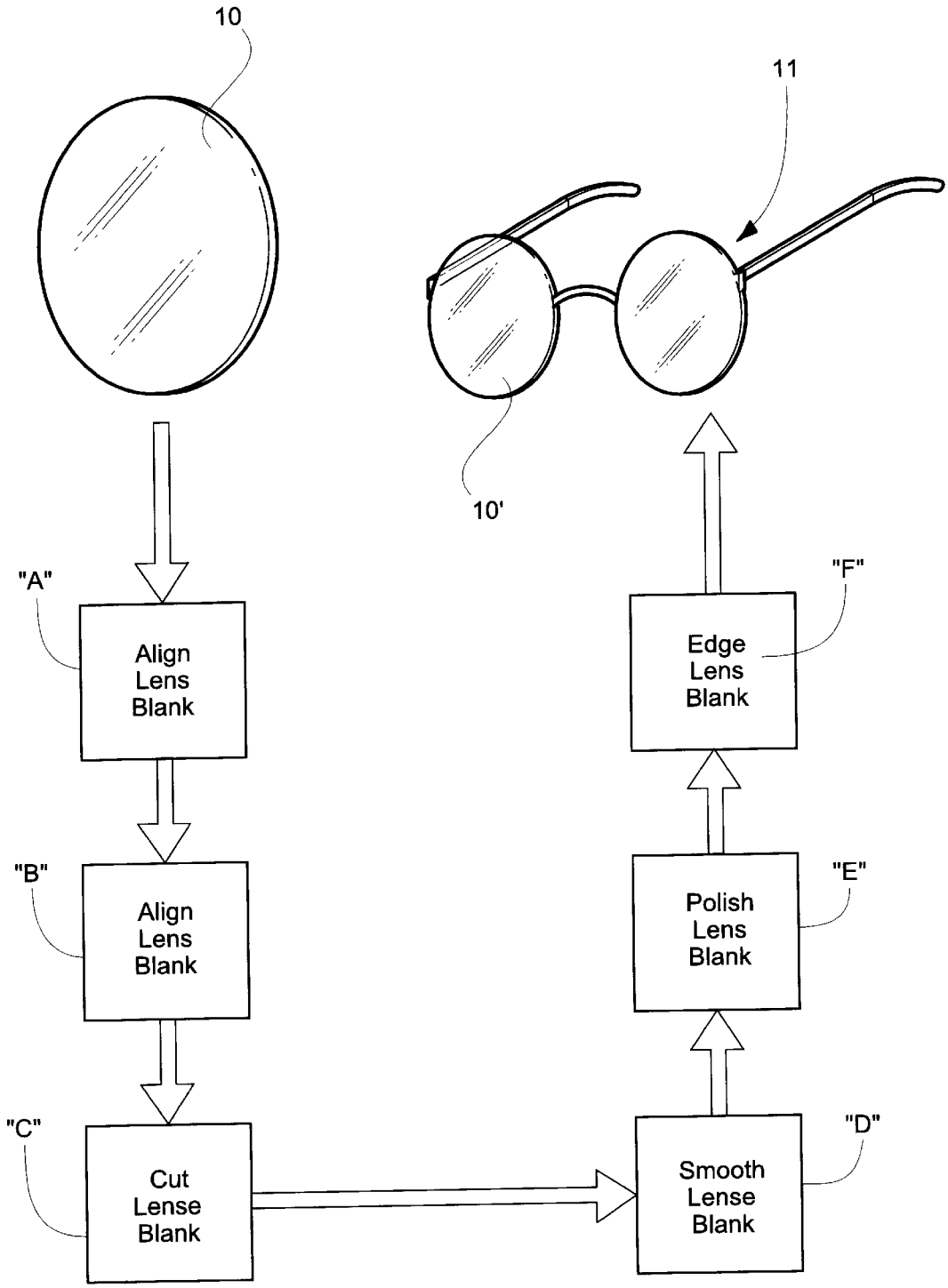
FIG. 1 is a flow diagram illustrating generally the process for making a prescription eyeglass lens.

Referring now specifically to the drawings, a system according to the present invention is described generally with reference to the flow diagram of FIG. 1. The system includes a number of processing stations A–F operable for transforming an ophthalmic lens blank 10 into a shaped lens 10' for prescription eyeglasses 11. The lens blank 10 has opposing inside and outside major surfaces. The inside major surface is concave and machined to a shape corresponding to a particular lens prescription. The outside major surface is convex.

In general terms, processing begins in an alignment station "A" where the lens blank 10 is aligned based on predetermined prescription parameters. The lens blank 10 is then transferred to a blocking station "B", and then to several surface generating stations "C", "D" and "E" where the lens blank 10 is machined to the prescription, ground, and polished. Processing is completed in a finishing station "F" where the lens blank is edged and fitted into eyeglasses 12.

ALIGNING AND BLOCKING THE LENS BLANK

Figure 2:
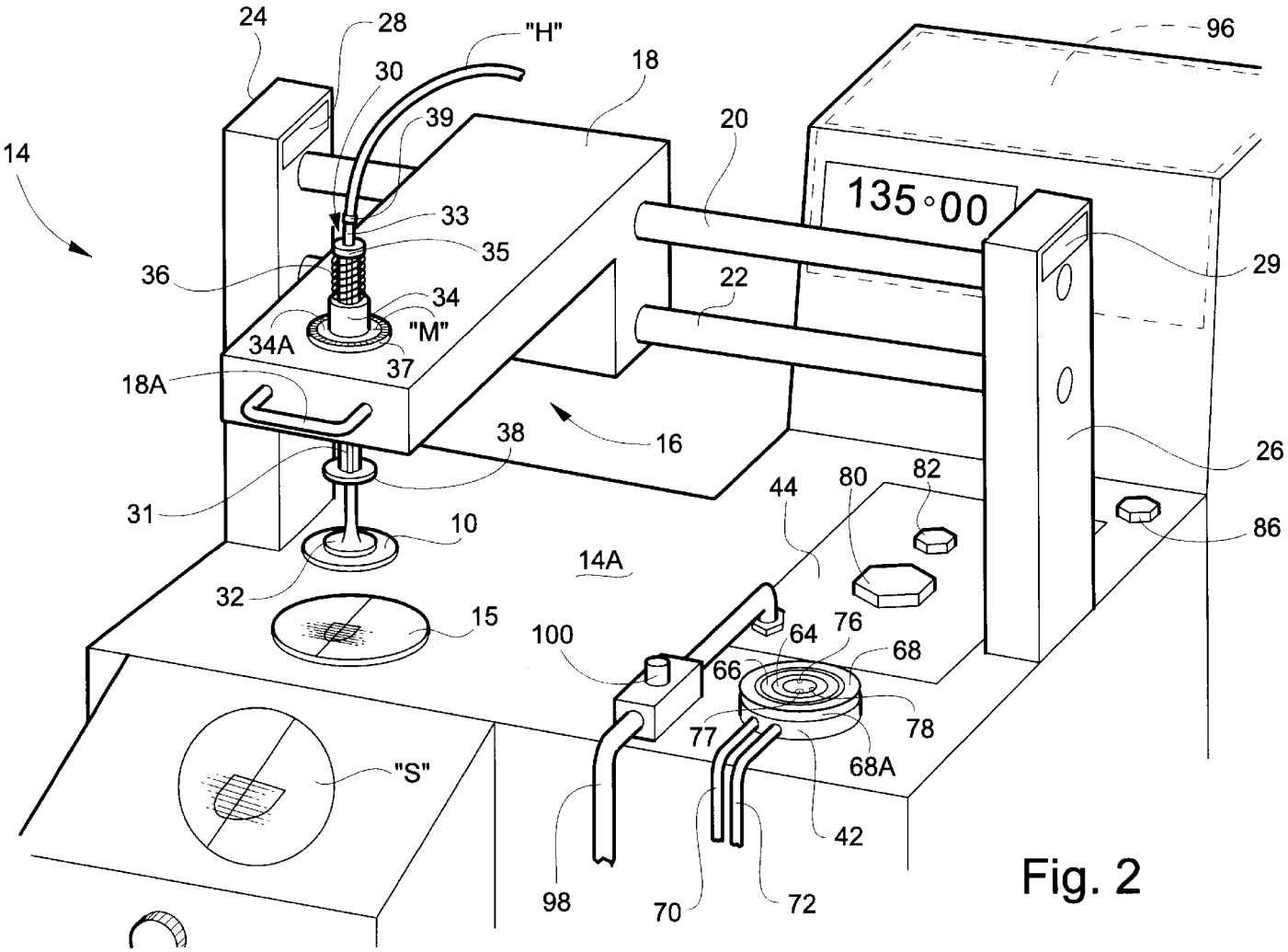
FIG. 2 is a lens alignment and wax blocking machine according to one preferred embodiment of the invention.
Figure 7:
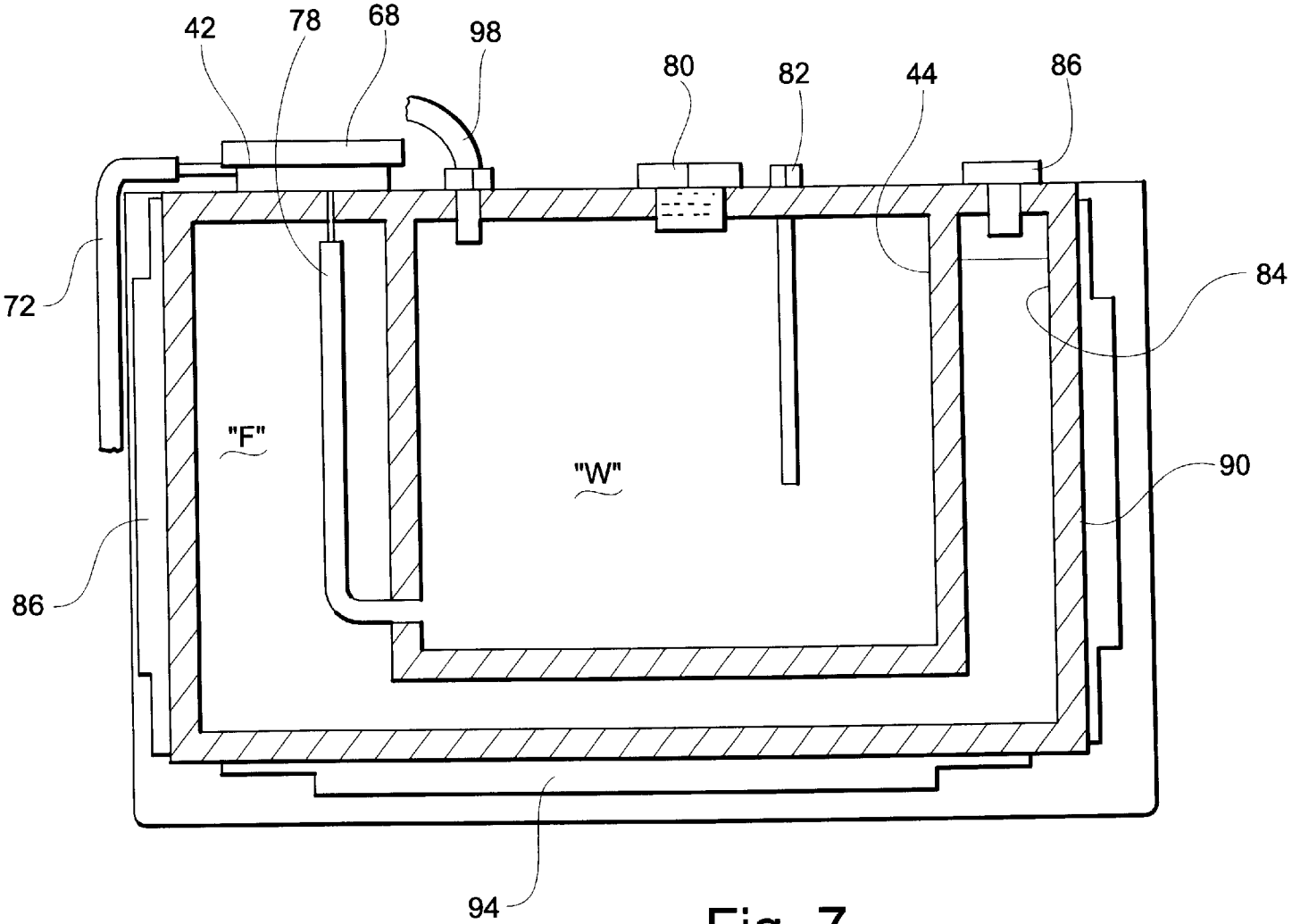
FIG. 7 is a side cross-sectional view of the wax container and fluid container of the wax blocking station.
Figure 8:
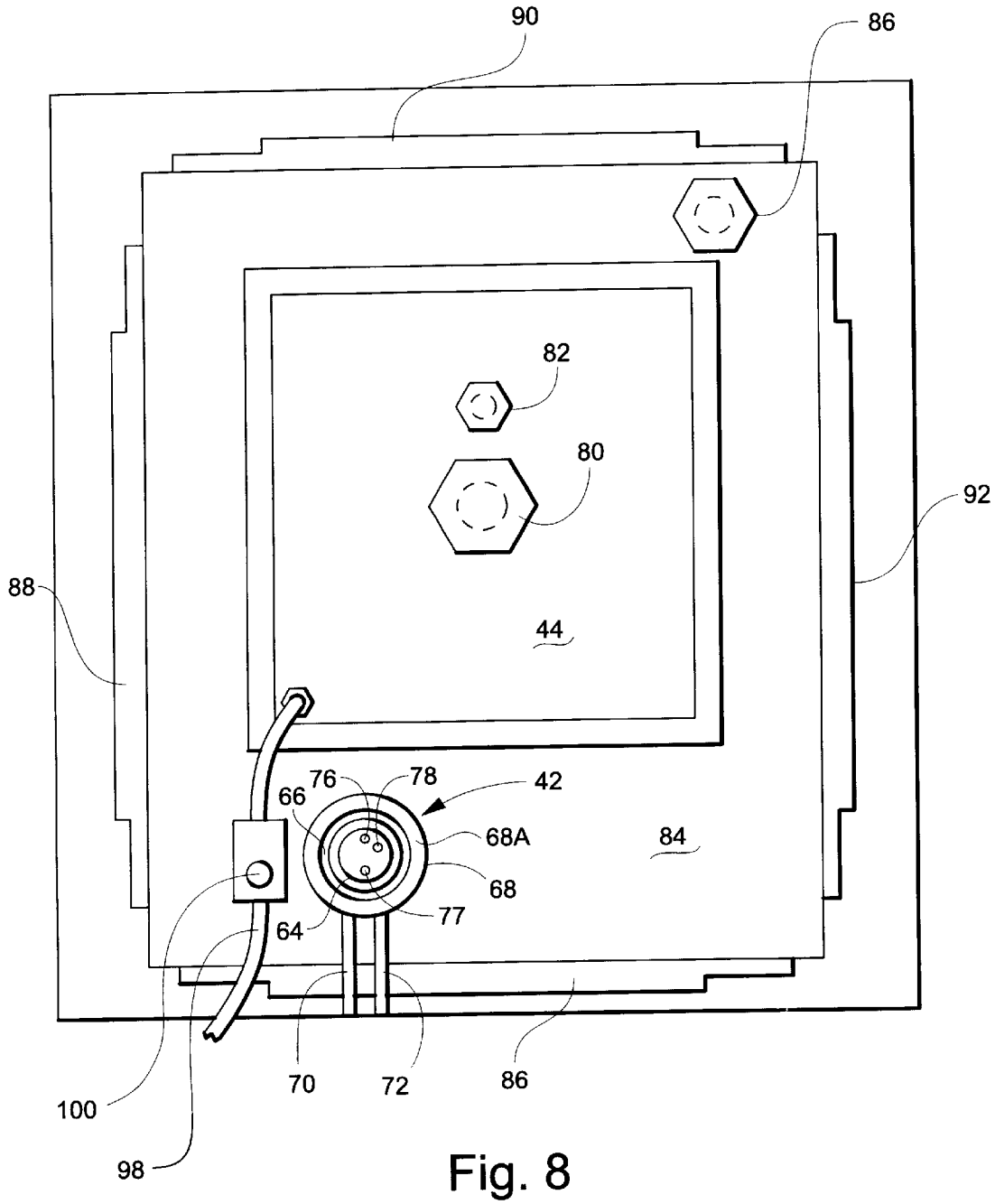
FIG. 8 is a top plan view of the wax container and fluid container of the wax blocking station.

A lens aligning and blocking machine 14 is shown in FIGS. 2, 7, and 8. The machine 14 includes a universal glass template 15 in the alignment station for aligning the bifocal of the lens blank 10. Preferably, a magnified display screen "S" is located adjacent the alignment station to allow convenient viewing of this process by the operator. After aligning the bifocal, the lens blank 10 is oriented to the proper axis and carried by a transfer assembly 16 to the blocking station, as described below. The transfer assembly 16 includes a carriage 18 mounted for sliding movement along spaced guide rods 20 and 22 extending between opposing side walls 24 and 26 of the machine 14. The side walls 24 and 26 include built-in magnets 28 and 29 for holding the metal carriage 18 in position adjacent the alignment station and the blocking station, respectively.

Figure 2A:
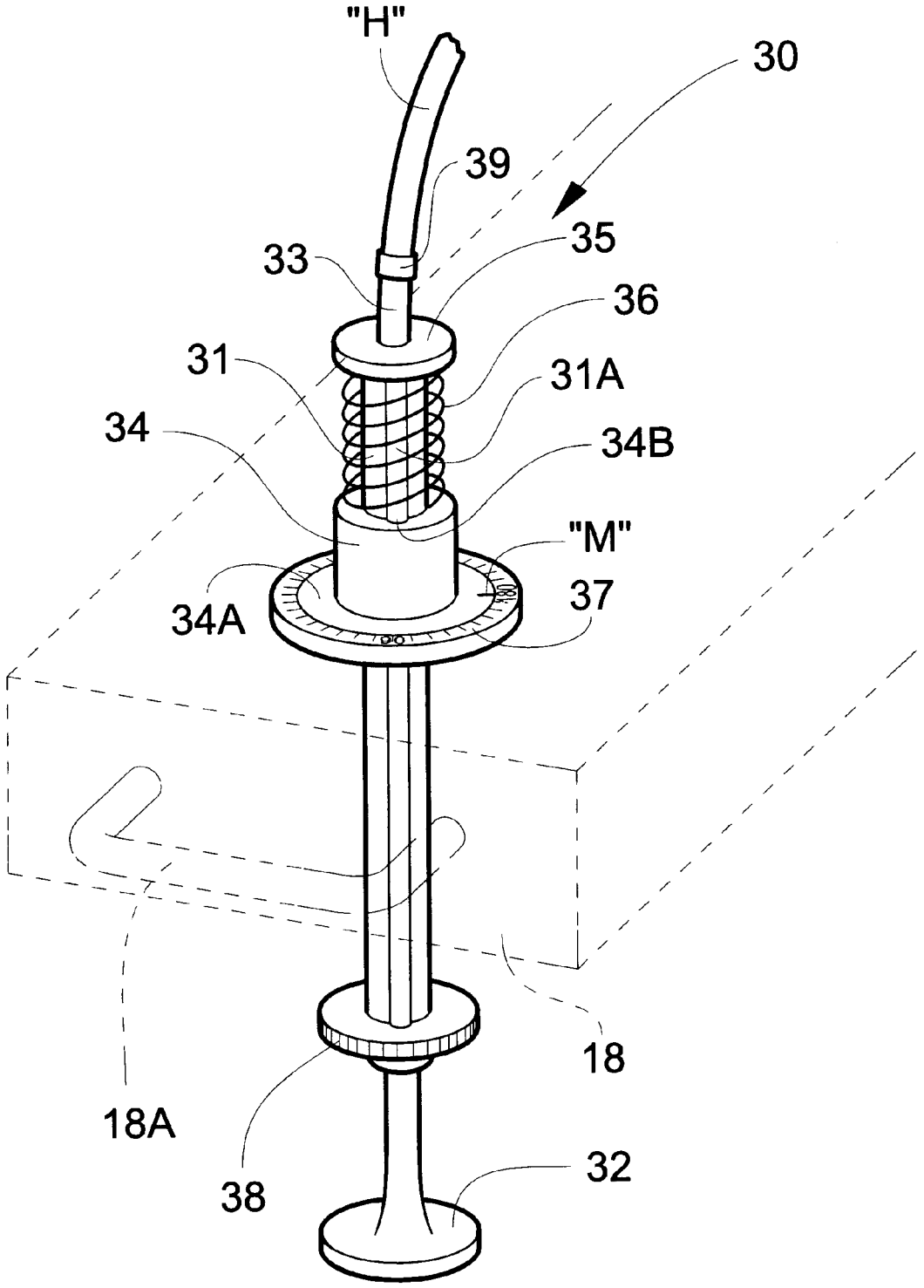
FIG. 2A is a perspective view of transfer arm and suction cup for lifting and lowering the lens blank in the alignment and blocking stations, and showing a portion of the carriage in phantom.

As shown in FIGS. 2 and 2A, a pneumatic transfer arm 30 is attached to the carriage 18 and includes an elongate hollow shaft 31 with a lens-engaging suction cup 32 at one end and a connecting tube 33 at the opposite end for connecting to a flexible air hose "H". The air hose "H" communicates with a conventional vacuum pump (not shown). Operation of the vacuum pump reduces air pressure at an opening of the suction cup 32 sufficient to hold the lens blank 10 in transit from the alignment station to the blocking station.

An outer cylinder 34, retaining disk 35, and spring 36 cooperate to normally urge the shaft 31 and suction cup 32 upwardly into a raised position above the surface 14A of the machine 14. The retaining disk 35 is attached to the shaft 31 and engages a top end of the spring 36. The bottom end of the spring 36 is supported on a top surface of the outer cylinder 34. The outer cylinder 34 has an annular bottom flange 34A and a longitudinal groove 34B in its inner wall for receiving a corresponding longitudinal detent 31A formed with the shaft 31. The mating detent 31A and groove 34B cooperate upon rotation of the shaft 31 to cause simultaneous rotation of the cylinder 34 and flange 34A. The flange 34A has a whisper mark "M" for manually aligning with a select marking on a stationary axis dial 37 used to set the axis of the lens blank 10.

An axis grip 38 is attached to the shaft 31 adjacent the suction cup 32 and is used for manually pulling the shaft 31 downwardly against the biasing force of the spring 36 and for rotating the shaft 31, cylinder 34 and flange 34A relative to the axis dial 37. To prevent the spring 36 from inadvertently slipping off the cylinder 34 when fully compressed, a further retaining ring (not shown) may be formed around the bottom end of the spring 36. A swivel nut 39 preferably connects the air hose "H" and transfer arm 30 together to allow free rotation of the shaft 31 relative to the hose "H".

After aligning the bifocal of the lens blank 10 on the template 15, the whisper mark "M" is set on the 180° mark of the axis dial 37 and the suction cup 32 manually lowered, as described above, to engage the concave surface of the lens blank 10. The "negatived" air pressure generated by the vacuum pump secures the lens blank 10 to the suction cup 32 in the lowered position and holds lens blank 10 to the suction cup 32 as the spring 36 urges the suction cup 32 back to its raised position. According to an alternative embodiment, the transfer arm 30 is actuated pneumatically using any suitable air cylinder or other pneumatic means.

With the lens blank 10 secured to the suction cup 32 above the template 15, as shown in FIG. 2, the operator uses the axis grip 38 to manually align the whisper mark "M" with the prescription axis mark on the axis dial 37. The carriage 18 is then moved using the handle 18A to transfer the lens blank 10 to the blocking station.

Figure 3:
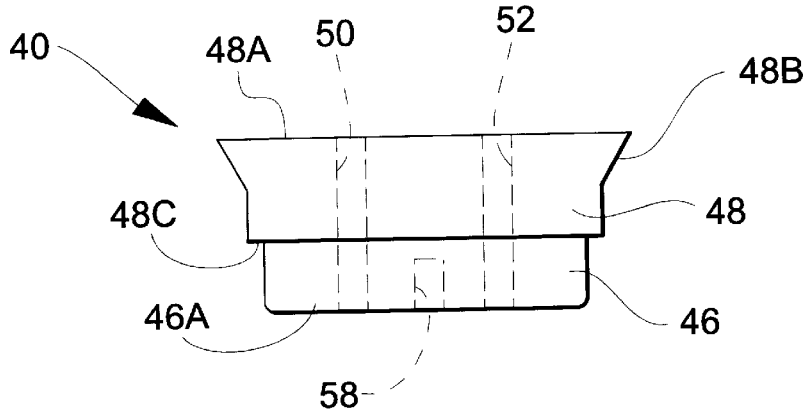
FIG. 3 is a side view of a lens block according to one preferred embodiment of the invention with openings of the lens block indicated in phantom.
Figure 4:
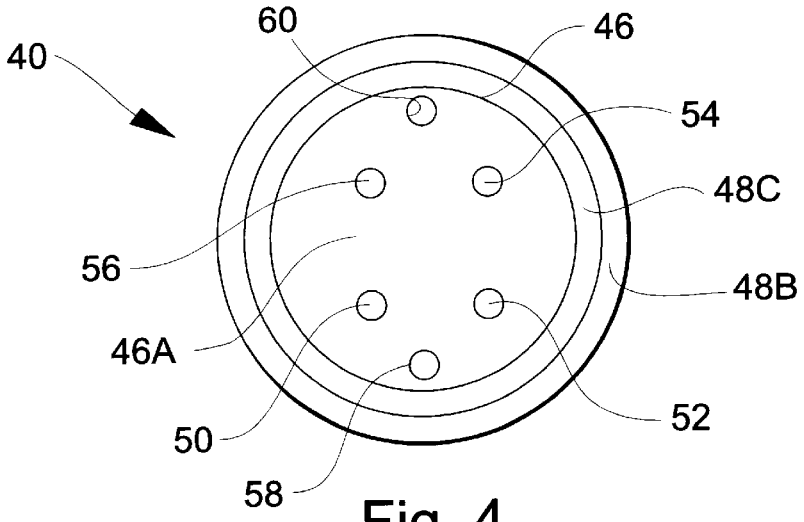
FIG. 4 is a bottom plan view of the lens block.
Figure 5:
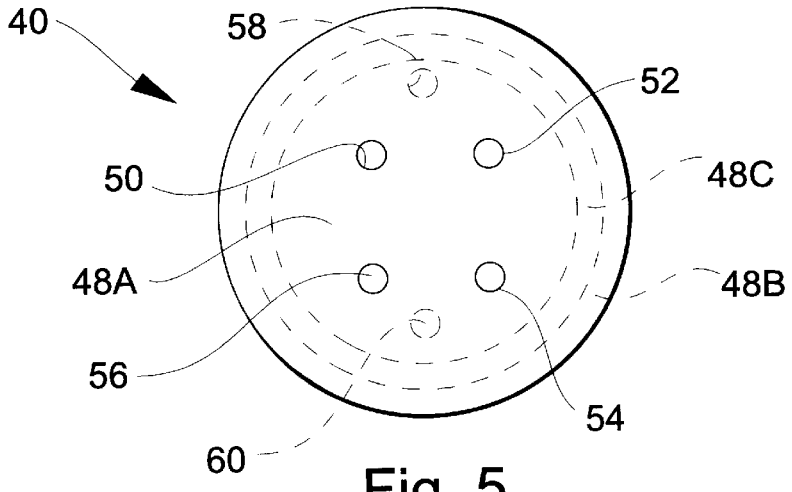
FIG. 5 is a top plan view of the lens block with the base and tapered edge indicated in phantom.

The blocking station includes a lens block 40, as shown in FIGS. 3–5, residing within the cavity of a metal blocking stand 42 mounted adjacent a sealed container 44 for holding liquid wax or other bonding material. The lens block 40 includes a base 46 having a metal base surface 46A, and lens mounting portion 48 integrally formed with the base 46. A number of openings 50, 52, 54, and 56 pass through the base 46 and mounting portion 48 from one side of the lens block 40 to the other. A second set of openings 58 and 60 are formed in the base surface 46A and terminate inside the lens block 40 at the mounting portion 48. The mounting portion 48 includes a lens-mounting surface 48A, an annular tapered edge 48B, and a shoulder 48C extending radially beyond the base 46.

Figure 6:
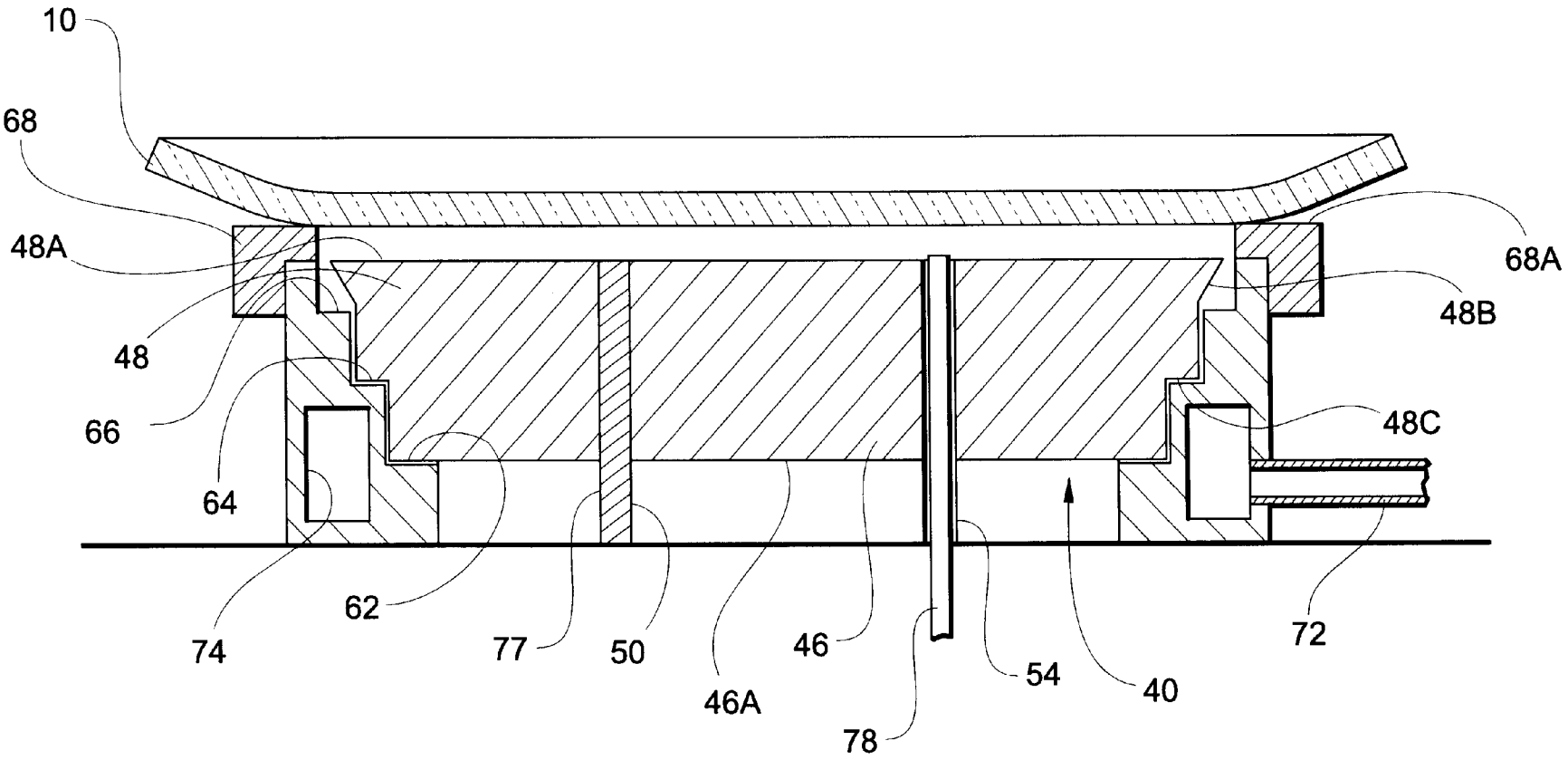
FIG. 6 is a cross-sectional view of the blocking stand and lens block with the lens blank positioned on the top surface of the chill ring.

As shown in FIG. 6, when positioned in the blocking stand 42, the base 46 of the lens block 40 sits on an annular interior ledge 62 of the blocking stand 42. The shoulder 48C of the mounting portion 48 sits on a first annular step 64, while the tapered edge 48B extends above a second annular step 66. An annular metal chill ring 68 fits over the top edge of the blocking stand 42, and has a top surface 68A spaced above the lens-mounting surface 48A of the lens block 40. A pair of coolant lines 70 and 72 are connected to the blocking stand 42 and operate to run coolant fluid through a passageway 74 formed through the stand 42 to refrigerate the chill ring 68. The coolant maintains the chill ring 68 at a temperature of about 55° F.

Upon transfer of the lens blank 10 to the blocking station, as described above, magnet 29 holds the metal carriage 18 in position adjacent side wall 26. The pneumatic transfer arm 30 lowers the suction cup 32 to position the lens blank 10 on the chill ring 68 of the blocking stand 42. Once in place, air flow through the suction cup 32 is closed and the transfer arm 30 retracted to return the suction cup 32 to its raised position above the blocking stand 42.

The lens block 40 resides a spaced distance beneath the lens blank 10, and is oriented to receive a pair of vertical alignment pegs 76 and 77 through openings 58 and 60 and the replaceable tip of a wax fill tube 78 through opening 54. The alignment pegs 76 are formed to the surface of the machine 14, and are arranged to orient the lens block on the 180. The was fill tube 78 extends from the blocking stand 42 at the surface of the machine 14 to the wax container 44.

Referring to FIGS. 7 and 8, the wax container 44 includes a fill plug 80 and thermocoupler 82 for measuring and controlling the temperature of the liquid wax "W". The wax "W" is preferably heated to about 135° F, and is maintained at the this temperature by heat transfer fluid "F" stored in an outer fluid container 84 surrounding the wax container 44. A second plug 86 is provided for filling the outer container 84. The outside walls of the container 84 are preferably insulated and include respective heaters 86, 88, 90, 92, and 94 for heating the fluid "F". The heat transfer fluid "F" may be water, anti-freeze, or other suitable liquid.

A controller 96 (See FIG. 2) is electrically connected to the thermocoupler 82, and operates to monitor the temperature of the wax "W" and adjust the heaters 86, 88, 90, 92, and 94 as required in order to maintain the desired temperature level. An air line 98 communicates with the interior of the sealed wax container 44 and is connected to an air regulator and compressor (not shown). An increase of air pressure inside the container 44 forces liquid wax "W" outwardly through the wax fill tube 78 to the blocking stand 42. Preferably, a manual push-button valve 100 controls the rate of increase and decrease of air pressure inside the wax container 44 and the resulting flow of wax "W" into the blocking stand 42.

Figure 9:
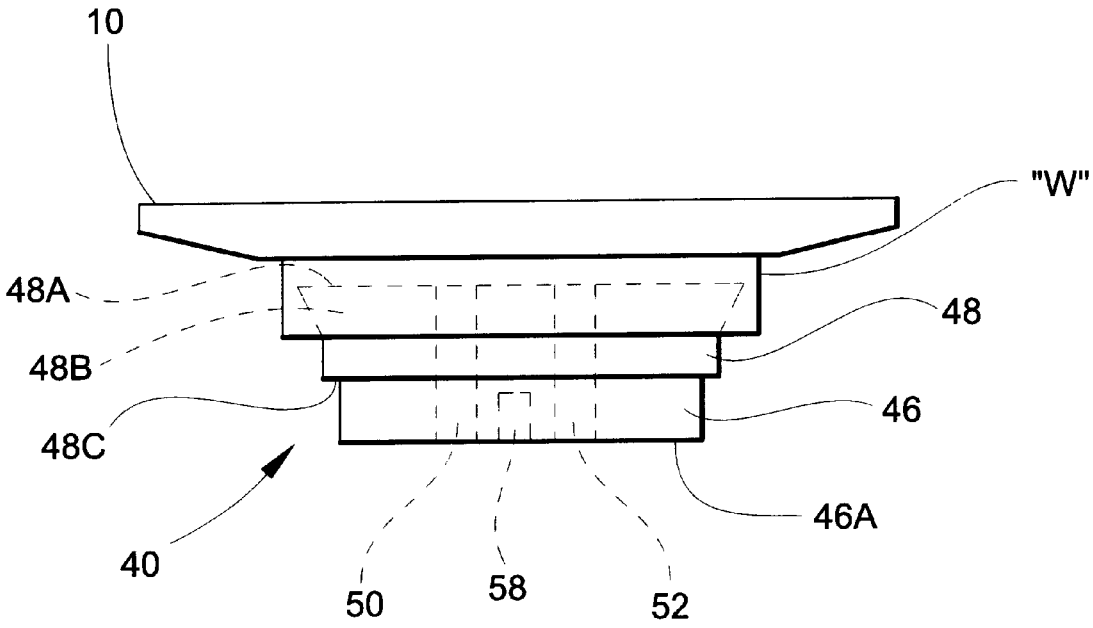
FIG. 9 is a side view of the lens blank attached to the lens block with portions of the lens block indicated in phantom.

As the heated liquid wax "W" enters the blocking stand 42, the chill ring 68 immediately cools tie wax "W" causing it to harden and form to the lens blank 40, the mounting surface 48A of the lens block 40, and around the tapered edge 48B of the lens block 40. The tapered edge 48B cooperates with the hardened wax "W" to resist shifting and separation of the lens blank 10 from the lens block 40 during subsequent processing. FIG. 9 shows the lens blank 10 and lens block 40 joined together by the wax "W".

CUTTING THE LENS PRESCRIPTION

After the lens blank 10 is aligned and blocked, as described above, it is passed to a standard cutting machine (not shown) in the first surface generating station "C". The cutting machine includes a computer-controlled cutting tool which automatically cuts a programmed lens prescription into the exposed lens surface of the lens blank 10. Examples of prior art cutting machines are described in U.S. Pat. Nos. 4,989,316 and 5,505,654 to Gerber Optical, Inc. These patents are incorporated herein by reference. After cutting, the lens blank 10 has a generally rough or "gray" surface quality and must be further processed, as described below, to finish the lens.

SMOOTHING AND POLISHING THE LENS BLANK 10

Smoothing and polishing the lens blank 10 take place in stations "D" and "E", respectively, on a lapping machine such as described in U.S. Pat. No. 3,893,264 to Textron, Inc. The complete disclosure of this patent is further incorporated herein by reference. The lapping machine uses a removable lap tool 102 (See FIG. 15) having a lens-conforming lap surface 104 custom shaped to precisely complement or match the base and cross curves of the given prescription. To finish the gray lens surface, a self-adhesive finishing pad 106 is placed over the surface 104 of the lap tool 102 and the lap tool 102 mounted on a high-speed tool carrier arm 108 of the lapping machine.

Figure 10:
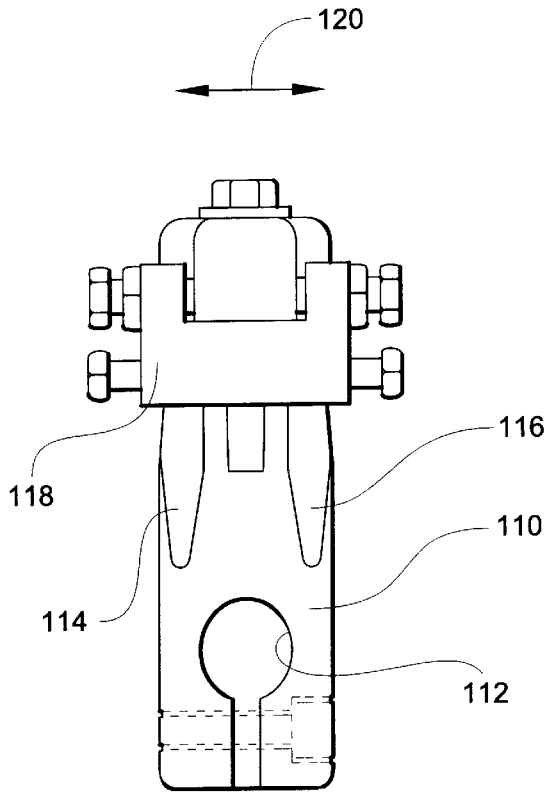
FIG. 10 is a front end view of a prior art block holder arm.
Figure 11:
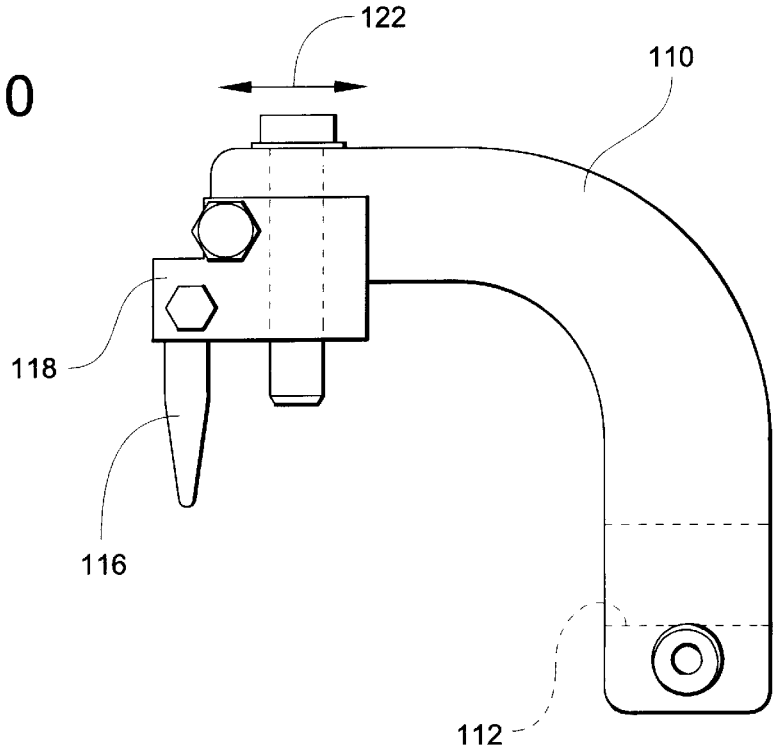
FIG. 11 is a side view of the prior art block holder arm shown in FIG. 10.

According to one prior art embodiment shown in FIGS. 10 and 11, a block holder arm 110 is located above the tool carrier arm 108 and is attached to the lapping machine through clamp opening 112. The block holder arm 110 includes spaced-apart block pins 114 and 116 extending downwardly from a pin holder 118. The block pins 114, 116 are adapted for being received into respective pin openings formed in the base surface of a lens block. The lens block and attached lens blank are loaded in the lapping machine by mating the block pins 114, 116 and pin openings, and manually holding the lens block in place as the block holder arm 110 lowers from a raised loading position above the lap tool 102 to an operative position adjacent the lap tool 102. The block holder arm 110 and pins 114, 116 cooperate with the lens block to maintain the lens blank in contact with the lap tool 102 as it moves in a high-speed, generally elliptical orbit. During operation of the lapping machine, the block holder arm 110 is slightly movable in a side-to-side direction, as indicated by arrow 120 in FIG. 10, but is immovable in a front-to-back direction indicated by arrow 122 in FIG. 11. The block pins 114, 116 are fixed to the pin holder 118 and require frequent replacement due to wear at their tips.

Figure 12:
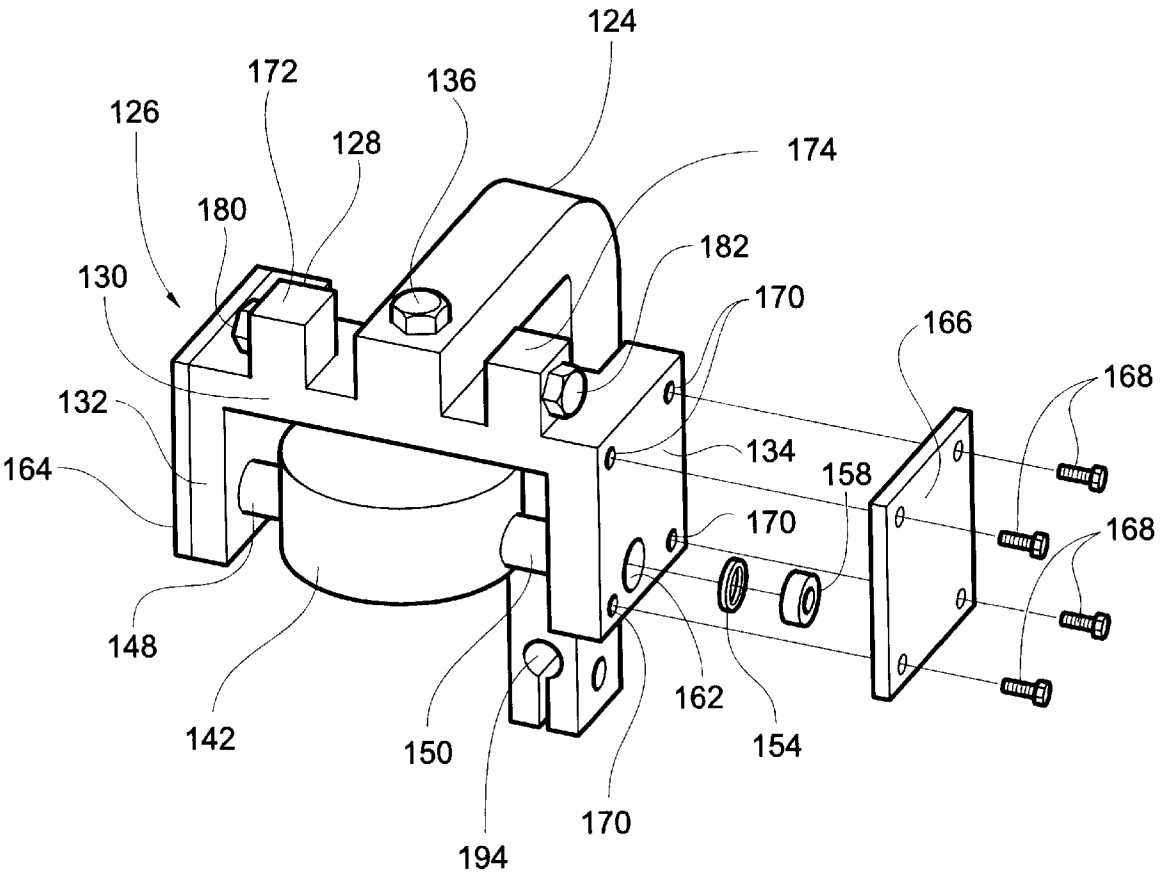
FIG. 12 is a perspective view of a block holder arm with an attached axis block assembly according to one preferred embodiment of the invention, and showing a portion of the mounting block exploded.
Figure 13:
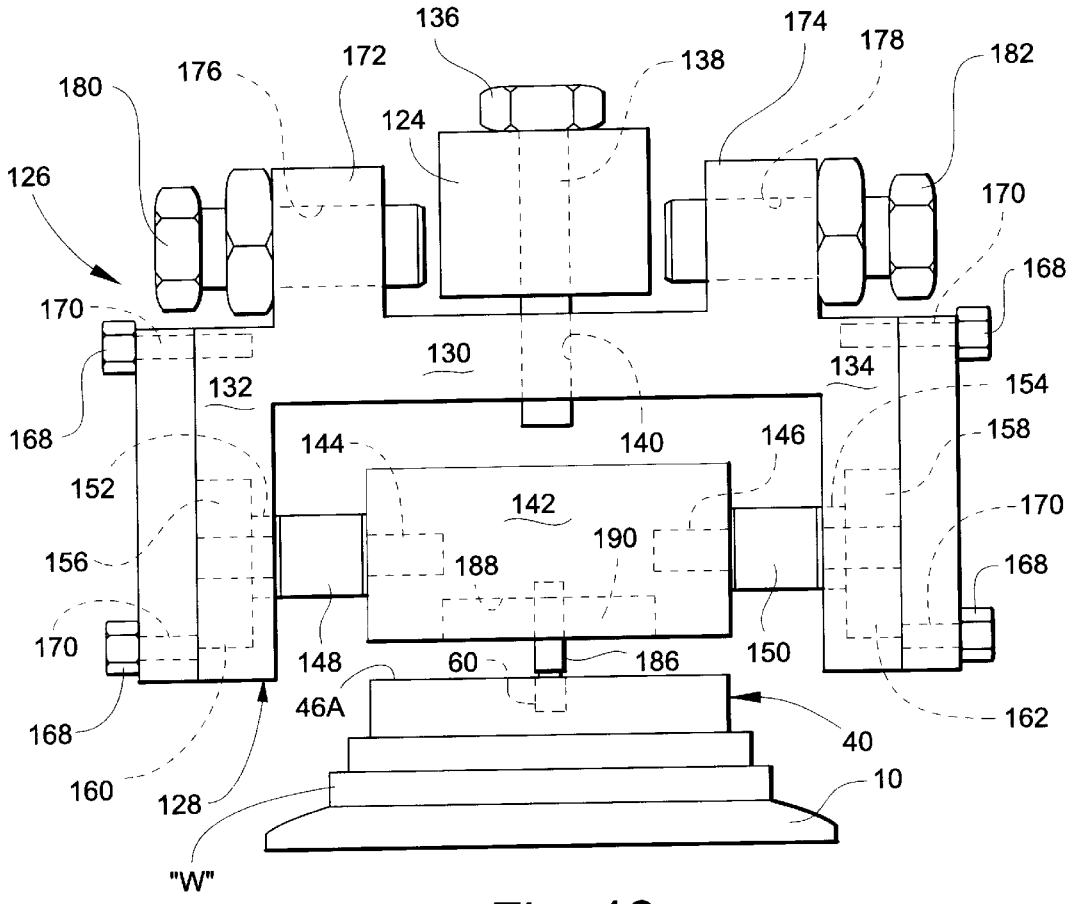
FIG. 13 is an enlarged front end view of the axis block assembly shown in FIG. 12.
Figure 15:
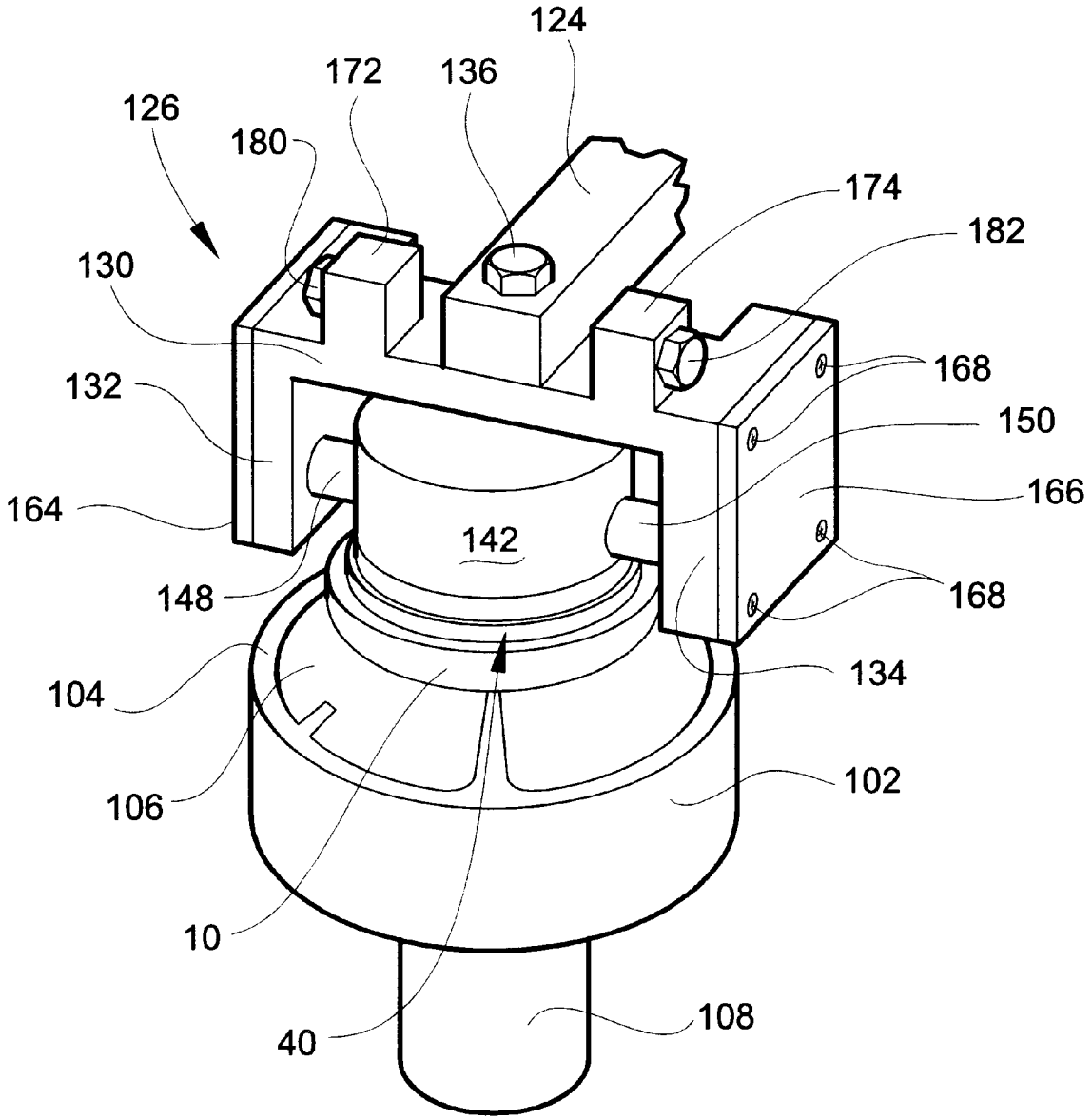
FIG. 15 is a fragmentary perspective view of the block holder arm in the operative position holding the axis block assembly adjacent the lap tool.

A block holder arm 124 including an attached axis block assembly 126 according to the present invention is shown in FIGS. 12, 13, and 15. The axis block assembly 126 includes a mounting block 128 having a top wall 130 and integrally-formed opposing side walls 132 and 134. The mounting block 128 is secured to the block holder arm 124 by a threaded attachment bolt 136 extending through aligned openings 138 and 140 (See FIG. 13) formed adjacent an end of the block holder arm 124 and in the top wall 130, respectively. The opening 140 preferably has an internal screw thread which mates with the external thread of the attachment bolt 136.

Figure 14:
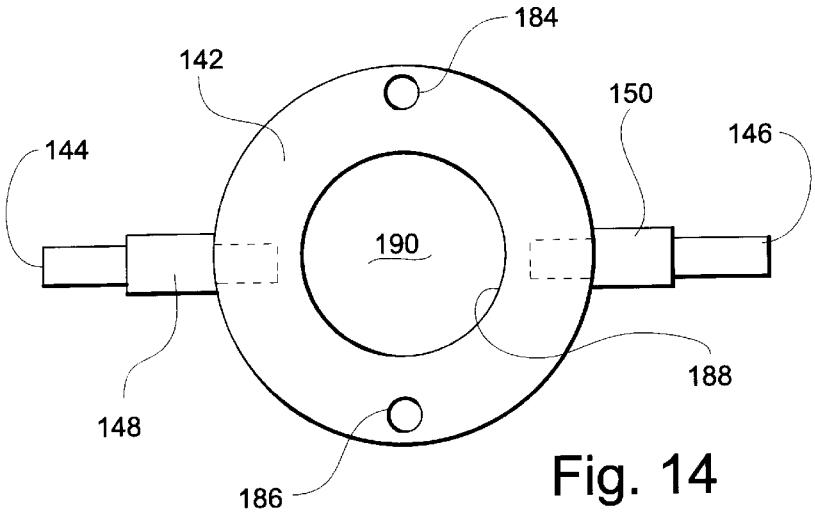
FIG. 14 is a bottom plan view of the axis block with portions of the mounting shafts indicated in phantom.

As best shown in FIGS. 13 and 14, an axis block 142 is carried on axially-aligned mounting shafts 144 and 146 between the opposing side walls 132 and 134 of the mounting block 128. The mounting shafts 144 and 146 are formed with cylindrical spacers 148 and 150 and extend through O-rings 152 and 154 and sealed bearings 156 and 158. The O-rings 152, 154 and sealed bearings 156, 158 reside in annular openings 160 and 162 formed in respective side walls 132 and 134 of the mounting block 128, as shown in FIG. 12.

Covers 164 and 166 are attached by threaded bolts 168 over the openings 160, 162 on an outside of the side walls 132, 134 to hold the O-rings 152, 154 and sealed bearings 156, 158 in place on respective mounting shafts 144 and 146 of the axis block 142. Preferably, the diameter of the spacers 148, 150 is substantially equal to the diameter of the inner races of the sealed bearings 156,158, such that when the covers 164,166 are removed, the O-rings 152, 154 and bearings 156, 158 are conveniently removed from within the openings 160, 162 by shifting the axis block 142 laterally towards each side wall 132,134. When shifted towards side wall 132, the spacer 148 of the axis block 142 engages O-ring 152 and forces it and the bearing 156 outwardly through opening 160. When shifted towards side wall 134, the spacer 150 engages O-ring 154 and forces it and the bearing 158 outwardly through opening 162.

Each side wall 132 and 134 further includes complementary threaded bolt holes 170 for receiving bolts 168. First and second axis adjustment heads 172 and 174 are integrally-formed with a top surface of the mounting block 128, and include openings 176 and 178 for receiving adjustment bolts 180 and 182. The adjustment bolts 180 and 182 are spaced slightly forward of the attachment bolt 136 and, when loosened, allow slight swivel adjustment of the mounting block 128 about a generally vertical axis defined by the attachment bolt 136 in order to properly align the axis. Once the axis is aligned, the position of the mounting block 128 is fixed by tightening the adjustment bolts 180 and 182 against the end of the block holder arm 124.

Referring to FIG. 14, the axis block 142 further includes a pair of spaced-apart downwardly projecting axis pins 184 and 186 adapted for being received within respective pin openings 58 and 60 formed in the base surface 46A of the lens block 40 (See FIGS. 3–5). A centrally disposed annular recess 188 is formed in the axis block 142 adjacent the axis pins 184 and 186 for receiving and storing a magnetic disk 190. The magnetic disk 190 attracts and holds the metal base surface 46A of the lens block 40 against the engaging surface of the axis block 142 with the axis pins 184 and 186 located in the pin openings 58 and 60. Unlike the prior art block holder arm 110 described above, the present axis block assembly 126 does not require the operator to manually hold the lens block 40 in alignment with the axis pins 184 and 186 as the block holder arm 124 lowers from the raised loading position above the lap tool 102 to the operative position adjacent the lap tool 102.

With lens block 40 and lens blank 10 loaded in the lapping machine, the block holder arm 124 and axis block 142 cooperate to maintain the lens blank 10 in contact with the lap tool 102 during operation of the lapping machine, as shown in FIG. 15. The pivot attachment of the axis block 142 to the mounting block 128 allows forward and rearward pivoting movement of the lens block 40 and lens blank 10 about an axis defined by the mounting shafts 144 and 146. The conventional attachment of the block holder arm 124 to the lapping machine through clamp opening 194 allows slight side-to-side pivoting movement of the lens block 40 and lens blank 10. The increased free movement of the axis block 142 results in less wear on the axis pins 184 and 186.

The self-adhesive finishing pad 106 applied to the lap tool 102 and used in the smoothing station is relatively coarse to quickly grind and smooth the gray surface of the lens blank 10. After smoothing, the finishing pad 106 is replaced with a finer pad used for polishing the lens blank 10 in the polishing station. Lens smoothing and polishing may take place on the same or separate lapping machines. Typically, a single lapping machine includes two tool carrier arms 108 with associated block holder arms 124 for both right-hand and left-hand lap tools 102.

Figure 16:
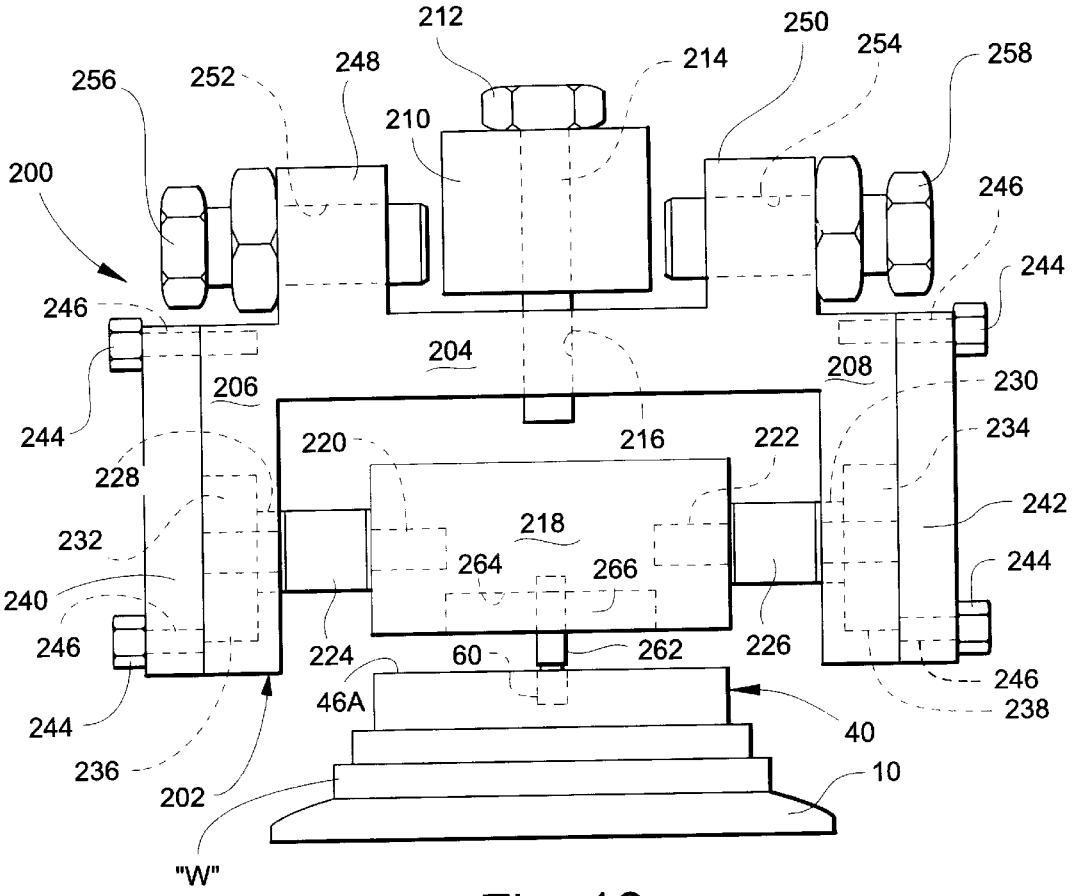
FIG. 16 is an enlarged front end view of an axis block assembly according to a second preferred embodiment of the invention.

A second embodiment of an axis block assembly 200 according to the invention is shown in FIG. 16. The axis block assembly 200 includes a mounting block 202 having a top wall 204 and integrally-formed opposing side walls 206 and 208. The mounting block 202 is secured to the block holder arm 210 by a threaded attachment bolt 212 extending through aligned openings 214 and 216 formed adjacent an end of the block holder arm 210 and in the top wall 204, respectively. The opening 216 preferably has an internal screw thread which mates with the external thread of the attachment bolt 212.

An axis block 218 is carried on axially-aligned mounting shafts 220 and 222 between the opposing side walls 206 and 208 of the mounting block 202. The mounting shafts 220 and 222 are formed with respective cylindrical spacers 224 and 226 and extend through O-rings 228 and 230 and sealed conical bearings 232 and 234. The O-rings 228, 230 and sealed bearings 232, 234 reside in annular openings 236 and 238 formed in respective side walls 206 and 208 of the mounting block 202.

Covers 240 and 242 are attached by threaded bolts 244 over the openings 236 and 238 on an outside of the side walls 206 and 208 to hold the O-rings 228, 230 and bearings 232, 234 in place on respective mounting shafts 220 and 222 of the axis block 218. Preferably, the diameter of the spacers 224, 226 is substantially equal to the diameter of the inner races of the sealed bearings 232, 234, such that when the covers 240, 242 are removed, the O-rings 228, 230 and bearings 232, 234 are conveniently removed from within the openings 236, 238 by shifting the axis block 218 laterally towards each side wall 206, 208. When shifted towards side wall 206, the spacer 224 of the axis block 218 engages O-ring 228 and forces it and the bearing 232 outwardly through opening 236. When shifted towards side wall 208, the spacer 226 engages O-ring 230 and forces it and the bearing 234 outwardly through opening 238.

Each side wall 206 and 208 includes complementary threaded bolt holes 246 for receiving bolts 244. First and second axis adjustment heads 248 and 250 are integrally-formed with a top surface of the mounting block 202, and include openings 252 and 254 for receiving adjustment bolts 256 and 258. The adjustment bolts 256 and 258 are spaced slightly forward of the attachment bolt 212 and, when loosened, allow slight swivel adjustment of the mounting block 202 about an axis defined by the attachment bolt 212 in order to properly align the axis. Once the axis is aligned, the position of the mounting block 202 is fixed by tightening the adjustment bolts 256 and 258 against the end of the block holder arm 210.

Figure 17:
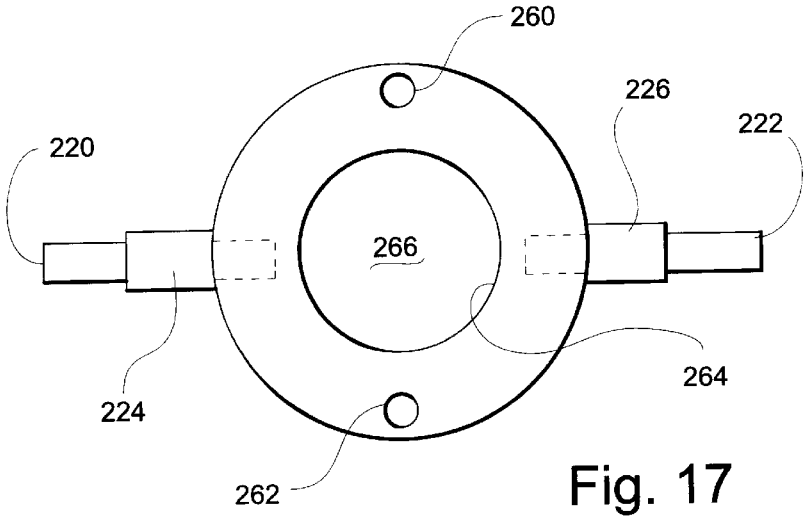
FIG. 17 is a bottom plan view of the axis block shown in FIG. 16 with portions of the mounting shafts indicated in phantom.

Referring to FIG. 17, the axis block 218 includes a pair of spaced-apart downwardly projecting axis pins 260 and 262 adapted for being received within respective pin openings 58 and 60 formed in the base surface 46A of the lens block 40. A centrally disposed annular recess 264 is formed in the axis block 218 adjacent the axis pins 260 and 262 for receiving a magnetic disk 266. The magnetic disk 266 attracts and holds the metal base surface 46A of the lens block 40 as the lens block 40 and lens blank 10 are loaded in the lapping machine, as previously described.

FINISHING THE LENS BLANK 10

After smoothing and polishing, the lens blank 10 is manually separated from the lens block 40 and passed to the finishing station where the lens blank 10 is edged and fitted into eyeglass frames. The finishing station may include any conventional edging machine known and used in the industry.

REMOVING THE WAX FROM THE LENS BLOCK

Upon separation of the lens blank 10 from the lens block 40, a substantial portion of hardened wax "W" generally adheres to the mounting portion 48 of the lens block 40. This wax is preferably removed using a wax removal device 300, as illustrated in FIGS. 18–20.

Figure 18:
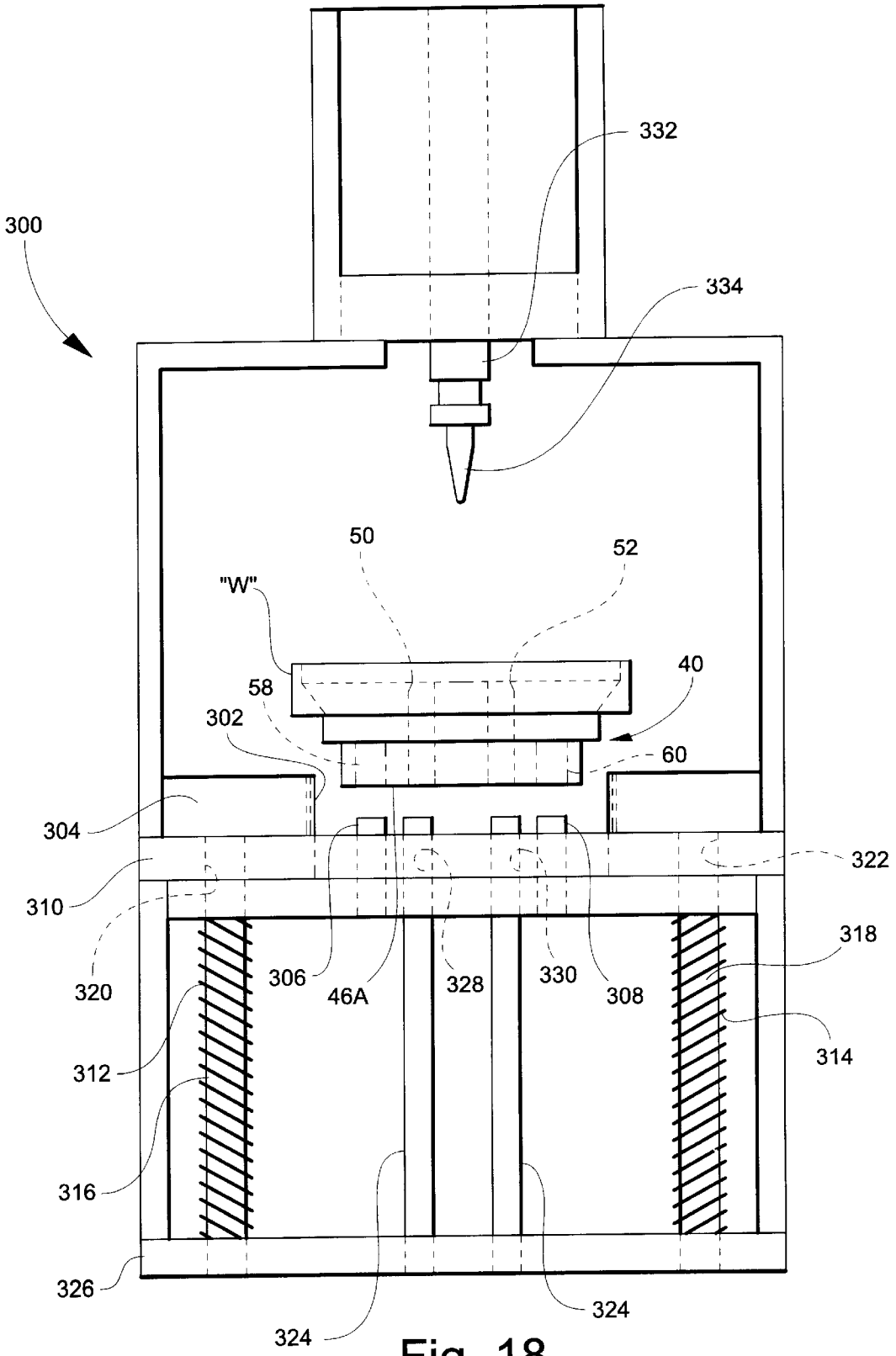
FIG. 18 is an elevational view of a wax removal device according to one preferred embodiment of the invention, and showing the lens blank positioned over the top floor of the device prior to wax removal with the pneumatic cylinder in a retracted position.

Referring to FIG. 18, the lens block 40 is placed in an annular opening 302 formed in a top floor 304 of the device 300 with the block 40 oriented such that the pin openings 58 and 60 in the base surface 46A mate with a pair of alignment pins 306 and 308 formed to the surface of a movable bottom floor 310. The diameter of the opening 302 corresponds substantially to the diameter of the lens-mounting surface 48A of the lens block 40. The bottom floor 310 is normally urged upwardly against the underside of the top floor 304 by springs 312 and 314 carried on vertical support rods 316 and 318. Openings 320 and 322 are formed in the bottom floor 310 of the device 300 sufficient for receiving the rods 316 and 318 therethrough, but sufficiently small to prevent passage of the springs 312 and 314. Four wax removal pins 324 (only two shown) extend vertically upward from the base 326 of the device 300, and are adapted for being received through openings 328 and 330 formed in the bottom floor 310. The wax removal pins 324 are spaced-apart to vertically align with openings 50, 52, 54, and 56 of the lens block 40 (See FIGS. 3–5).

A pneumatic cylinder 332 is mounted above the top floor 304 of the device 300 and includes an actuating finger 334 with a pointed end for penetrating the wax "W" covering the lens-mounting surface 48A of the lens block 40. The finger 334 resides initially in a retracted position, shown in FIG. 18, as the lens block 40 is placed by the operator within the annular opening 302 of the top floor 304. Activation of the pneumatic cylinder 332 moves the finger 334 vertically downwardly to engage the lens block 40, as shown in FIG. 19. Further movement of the finger 334 pushes the lens block 40 through the opening 302, and moves the bottom floor 310 downwardly against the biasing force of the springs 312 and 314. As shown in FIG. 20, wax removal pins 324 extend through openings 50, 52, 54, and 56 in the lens block 40 to remove wax "W" adhering to the lens-engaging surface 48A. Wax "W" adhering to the periphery of the lens block 40 is pushed away from the lens block 40 by the edge of the top floor 304 adjacent the opening 302. Upon retraction of the cylinder 332, the removed wax "W" adheres to the finger 334 and is manually removed by the operator and recycled. In an alternative embodiment, the lens block 40 is manually forced downwardly by the operator through the opening 302 of the top floor 304 without the use of a pneumatic cylinder.

A system for making prescription eyeglass lenses is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An axis block assembly for being attached to a block holder arm of a lapping machine, and cooperating with a lens block to hold a lens blank in contact with a lap tool used for finishing a surface of the lens blank, the block holder arm moving the axis block assembly between a raised loading position spaced above the lap tool for loading the lens block and lens blank in the lapping machine, and lowered operative position for locating the axis block assembly proximate the lap tool during operation of the lapping machine, said axis block assembly comprising:

(a) a mounting block for being attached to an end of the block holder arm, and comprising a top wall with an opening therein for alignment with a corresponding opening formed adjacent the end of the block holder arm, and an attachment bolt for being received through each of said aligned openings for attaching said mounting block to the block holder arm, and allowing adjustment of said mounting block about an axis defined by said attachment bolt;

(b) first and second spaced-apart axis adjustment heads formed with the top wall of said mounting block on opposite sides of said attachment bolt opening, and including respective adjustment bolt openings forward of said attachment bolt opening and receiving adjustment bolts for adjustably locking the mounting block in position on the block holder arm;

(c) an axis block carried by said mounting block; and (d) said axis block comprising a magnetic surface adapted for engaging a metal base surface of the lens block for holding the lens block against the axis block as the axis block assembly moves from the raised loading position to the lowered operative position proximate the lap tool.

2. An axis block assembly according to claim 1, wherein the magnetic surface of said axis block comprises a centrally disposed magnetic disk located within an annular recess formed in said axis block.

3. An axis block assembly according to claim 1, wherein said mounting block comprises spaced-apart opposing side walls formed with said top wall and residing on opposite sides of said axis block for locating said axis block within said axis block assembly.

4. An axis block assembly according to claim 3, wherein said axis block comprises first and second axially-aligned mounting shafts extending within respective side walls of said mounting block.

5. An axis block assembly according to claim 4, and comprising first and second shaft bearings located adjacent respective side walls of said mounting block for receiving respective ends of said first and second mounting shafts for pivoting movement of said shafts within said bearings.

6. An axis block according to claim 3, and comprising first and second covers removably attached to an outside of respective side walls.

7. An axis block assembly according to claim 4, wherein said first and second mounting shafts have respective tapered ends received within the side walls of said mounting block.

8. An axis block assembly according to claim 7, comprising first and second conical shaft bearings located adjacent respective side walls of said mounting block for receiving respective tapered ends of said first and second mounting shafts for pivoting movement of said shafts within said bearings.

9. An axis block assembly according to claim 1, wherein said axis block comprises first and second spaced-apart axis pins adapted for being received within respective pin openings formed in the base surface of the lens block for holding the lens block in position during operation of the lapping machine.

10. An axis block assembly for being attached to a block holder arm of a lapping machine, and cooperating with a lens block to hold a lens blank in contact with a lap tool used for finishing a surface of the lens blank, the block holder arm moving the axis block assembly between a raised loading position spaced above the lap tool for loading the lens block and lens blank in the lapping machine, and lowered operative position for locating the axis block assembly proximate the lap tool during operation of the lapping machine, said axis block assembly comprising:

(a) a mounting block for being attached to an end of the block holder arm;

(b) an axis block carried by said mounting block, said mounting block comprising a top wall and spaced-apart opposing side walls formed with said top wall and residing on opposite sides of said axis block for locating said axis block within said axis block assembly, and said axis block comprising first and second axially-aligned mounting shafts extending within respective side walls of said mounting block; and (c) pivot attachment means for pivotably attaching said axis block to said mounting block, and allowing pivoting movement of said axis block relative to said mounting block during operation of the lapping machine.

11. An axis block assembly according to claim 10, and comprising first and second shaft bearings located adjacent respective side walls of said mounting block for receiving respective ends of said first and second mounting shafts for pivoting movement of said shafts within said bearings.

12. An axis block assembly according to claim 10, wherein said first and second mounting shafts have respective tapered ends received within the side walls of said mounting block.

13. An axis block assembly according to claims 12, comprising first and second conical shaft bearings located adjacent respective side walls of said mounting block for receiving respective tapered ends of said first and second mounting shafts for pivoting movement of said shafts within said bearings.

14. An axis block assembly according to claim 10, wherein said axis block comprises first and second spaced-apart axis pins adapted for being received within respective pin openings formed in the base surface of the lens block for holding the lens block in position during operation of the lapping machine.

15. In combination with a lapping machine for finishing a surface of an ophthalmic lens blank, the improvement comprising an axis block assembly for being attached to a block holder arm of the lapping machine and cooperating with a lens block to hold the lens blank in contact with a moving lap tool, the block holder arm moving the axis block assembly between a raised loading position spaced above the lap tool for loading the lens block and lens blank in the lapping machine, and lowered operative position for locating the axis block assembly proximate the lap tool during operation of the lapping machine, said axis block assembly comprising:

(a) a mounting block for being attached to an end of the block holder arm, and comprising a top wall with an opening therein for alignment with a corresponding opening formed adjacent the end of the block holder arm, and an attachment bolt for being received through each of said aligned openings for attaching said mounting block to the block holder arm, and allowing adjustment of said mounting block about an axis defined by said attachment bolt;

(b) first and second spaced-apart axis adjustment heads formed with the top wall of said mounting block on opposite sides of said attachment bolt opening, and including respective adjustment bolt openings forward of said attachment bolt opening and receiving adjustment bolts for adjustably locking the mounting block in position on the block holder arm;

(c) an axis block carried by said mounting block; and (d) said axis block comprising a magnetic surface adapted for engaging a metal base surface of the lens block for holding the lens block against the axis block as the axis block assembly moves from the raised loading position to the lowered operative position proximate the lap tool.

16. In combination with a lapping machine for finishing a surface of an ophthalmic lens blank, the improvement comprising an axis block assembly for being attached to a block holder arm of the lapping machine and cooperating with a lens block to hold the lens blank in contact with a moving lap tool, the block holder arm moving the axis block assembly between a raised loading position spaced above the lap tool for loading the lens block and lens blank in the lapping machine, and lowered operative position for locating the axis block assembly proximate the lap tool during operation of the lapping machine, said axis block assembly comprising:

(a) a mounting block for being attached to an end of the block holder arm;

(b) an axis block carried by said mounting block, said mounting block comprising a top wall and spaced-apart opposing side walls formed with said top wall and residing on opposite sides of said axis block for locating said axis block within said axis block assembly, and said axis block comprising first and second axially-aligned mounting shafts extending within respective said walls of said mounting block; and (c) pivot attachment means for pivotably attaching said axis block to said mounting block, and allowing pivoting movement of said axis block relative to said mounting block during operation of the lapping machine.

* * * * *